United States Patent [19]

Hollingsworth

[11] Patent Number: 4,991,472

[45] Date of Patent: Feb. 12, 1991

[54] D.C. DIRECT DRIVE IMPACT WRENCH

[75] Inventor: Lyndol W. Hollingsworth, Wichita Falls, Tex.

[73] Assignee: James Curtis Hilliard, Dallas, Tex. ; a part interest

[21] Appl. No.: 267,081

[22] Filed: Nov. 4, 1988

[51] Int. Cl.[5] ..... B25B 19/00

[52] U.S. Cl. ..... 81/464; 173/93.5

[58] Field of Search ..... 81/463-466; 173/117, 93, 93.5, 109, 110, 111, 170, 163; 439/502-504

[56] References Cited

U.S. PATENT DOCUMENTS

| | | | |
|---|---|---|---|
| 3,552,499 | 1/1971 | Maurer | 173/93 |
| 3,734,205 | 5/1973 | Maurer | 173/93.5 |
| 4,347,902 | 9/1982 | Wallace et al. | 173/93.5 |
| 4,619,162 | 10/1986 | Van Laere | 81/464 |
| 4,667,119 | 5/1987 | Holmes | 173/170 X |

FOREIGN PATENT DOCUMENTS

| | | | |
|---|---|---|---|
| 2042012 | 3/1972 | Fed. Rep. of Germany | 81/464 |
| 2455495 | 1/1981 | France | 81/464 |

*Primary Examiner*—D. S. Meislin

[57] ABSTRACT

An impact tool comprised of a light weight housing having a forward anvil and hammer compartment, a hollow handle, and a rear cradle to receive a 12 volt motor, its housing and wiring therefor, with the motor removably accessible by the removal of only two threaded bolts. A trigger operated on-off switch is mounted in the handle.

10 Claims, 6 Drawing Sheets

D.C. DIRECT DRIVE IMPACT WRENCH

FIELD OF INVENTION

The invention relates to impact tools, in general, and more particularly to, a D.C. (direct current) motor powered impact wrench.

BACKGROUND OF THE INVENTION

The only known present day commercially available electrically operated impact wrenches are A.C. (alternating current) powered. Such devices are characterized by inherent disadvantages due to their motors and necessarily associated parts.

First, the number of moving parts is excessive which results in wear and tear and frequent failure.

Second, gears are interposed in the drive, resulting in lower torque than direct drive and in gear wear and stripping.

Third, electrical shock from A. C. is more dangerous to humans.

Fourth, the complex drive and design limits the A. C. wrenches to ¾ inch and smaller impact wrenches.

Fifth, A. C. impact wrenches are very expensive to purchase.

Sixth, A. C. wrenches do not admit of portability because their operation depends upon generators of A.C. current which can provide the proper amperage or current level. Generator size and weight is determined by this amperage requirement.

Seventh, A.C. wrenches are not readily disassemblable and serviceable by the owner.

These disadvantages are eliminated by the present invention.

Problems which are solved by the present invention are also associated with pneumatic wrenches.

All such wrenches suffer from moisture present due to compressing air. The powering vanes absorb this moisture, and become swollen, preventing them from sliding into proper position to attain optimum power. Also, pipe scalings and rust are pushed through the air lines. The air gun's exhaust contains residues that pollute the air in the vicinity of the operator. Air compressors are very heavy, expensive to purchase and operate. The use of highly compressed, bottled oxygen is expensive and very dangerous if the bottle is ruptured.

Neither the A.C. nor pneumatic wrench is suited to field military useage because they require an A.C. source or compressed air. Generators produce noise and require gasoline or alternate fuels. Without A.C. power to run a compressor, a gasoline engine would be needed to create compressed air.

SUMMARY OF PRESENT INVENTION

The invention is comprised of a light weight housing having a forward hammer and anvil compartment, a hollow handle, and a rear cradle to receive a 12 volt motor, its housing and wiring therefor, with the motor removably accessible by the removal of only two threaded bolts. A trigger operated ON-OFF switch, mounted in the handle, receives the motor wires, and also, the battery wires by way of a rotatable reversing switch in the lower portion of the handle for forward and reverse operation.

A bushing fits within the forward end of the housing to hold the anvil in place and make it run true. The rear of the anvil is bevelled for striking. An anvil sleeve with tandem anvil sleeve pins fits over the bevelled end of the anvil, then the anvil sleeve slides inside the hammer. The assembly is held in place by a steel snap ring. Then, the whole hammer assembly is suspended in the housing compartment and is readily lubricated, facilitated by the easy two screw motor removal. An end bell aligns the motor housing to the wrench housing and insures a good seal forward and rear. Bearings are preferably used at both ends of the motor. Thus completed, the entire wrench weighs only about 10 pounds and develops about 200 foot pounds of torque with its ½ inch drive. The structure admits of ready size increases to create ¾ inch and 1 inch drive models or can be decreased to create ⅜ inch or ¼ inch models. The 1 inch model is capable of producing up to 600 foot pounds of torque when powered by a 12 volt car battery. Applications include field use by the military both in dry and wet climate conditions as well as farmers, ranchers, electrical company linemen, cable TV personnel, and many others. The invention also comprises a unique housing for the wrench assembly.

DESCRIPTION OF THE PREFERRED EMBODIMENT OF THE INVENTION

Figure 1:
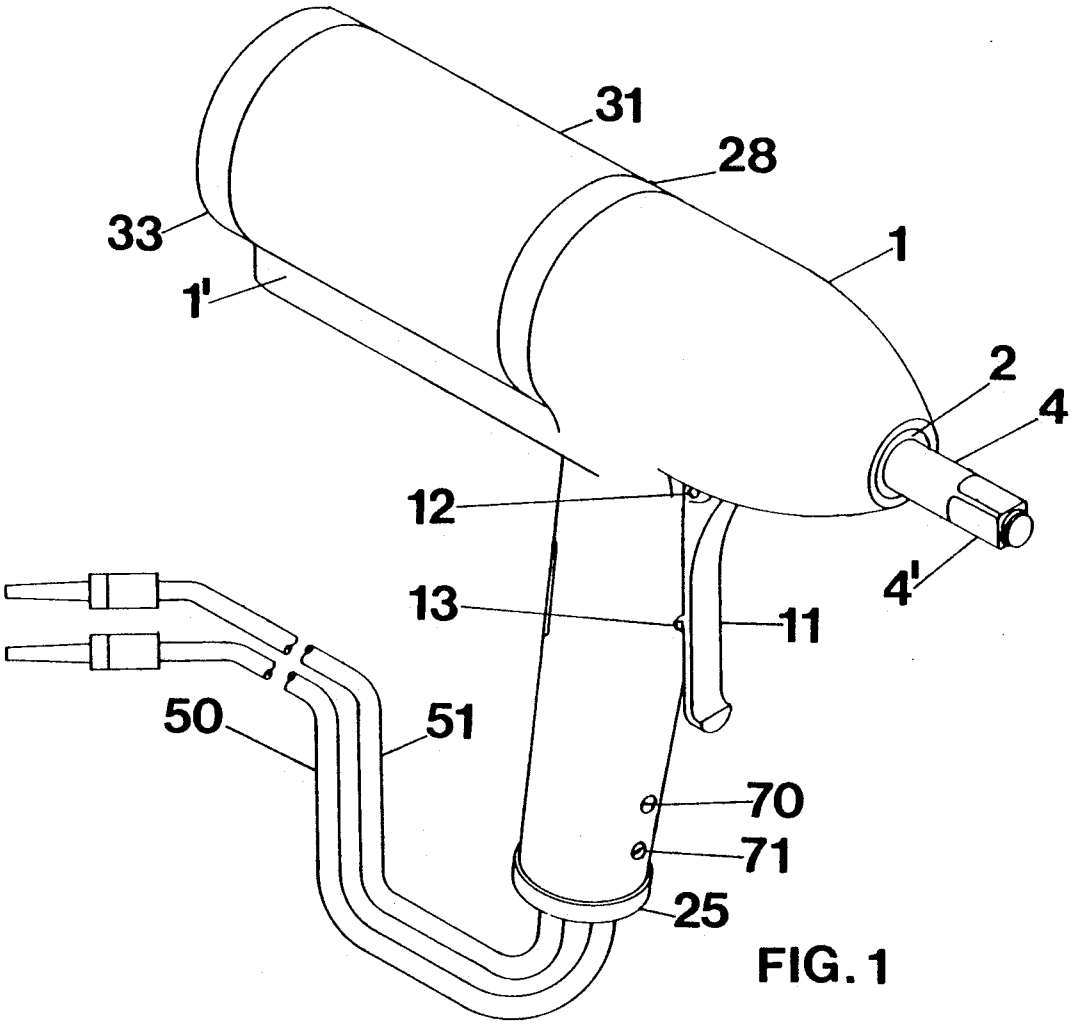
FIG. 1 is a view in perspective of the D.C. impact tool with short jumpers attached.
Figures 2, 2A, 2B, 2C, 2D, 2E:
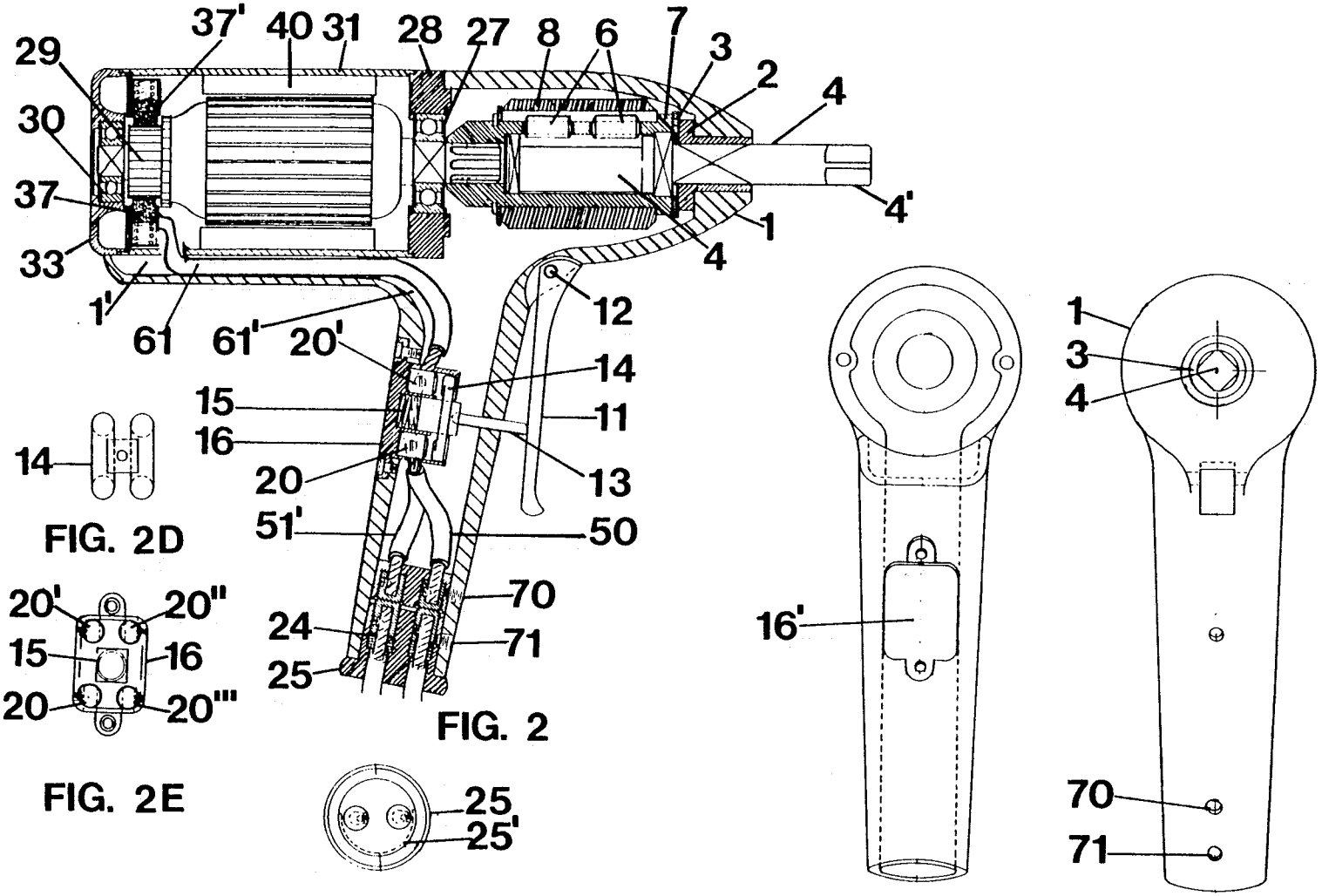
FIG. 2 is a cross sectional view of the tool of FIG. 1.
FIG. 2A is a bottom view of the handle of the tool of FIG. 2.
FIG. 2B is a front elevational view of the tool of FIG. 2.
FIG. 2C is a rear view of the tool of FIG. 2.
FIG. 2D shows the double contact member for the On-Off switch.
FIG. 2E is a front view of the On-Off switch showing the inner switch contacts.
Figure 3:
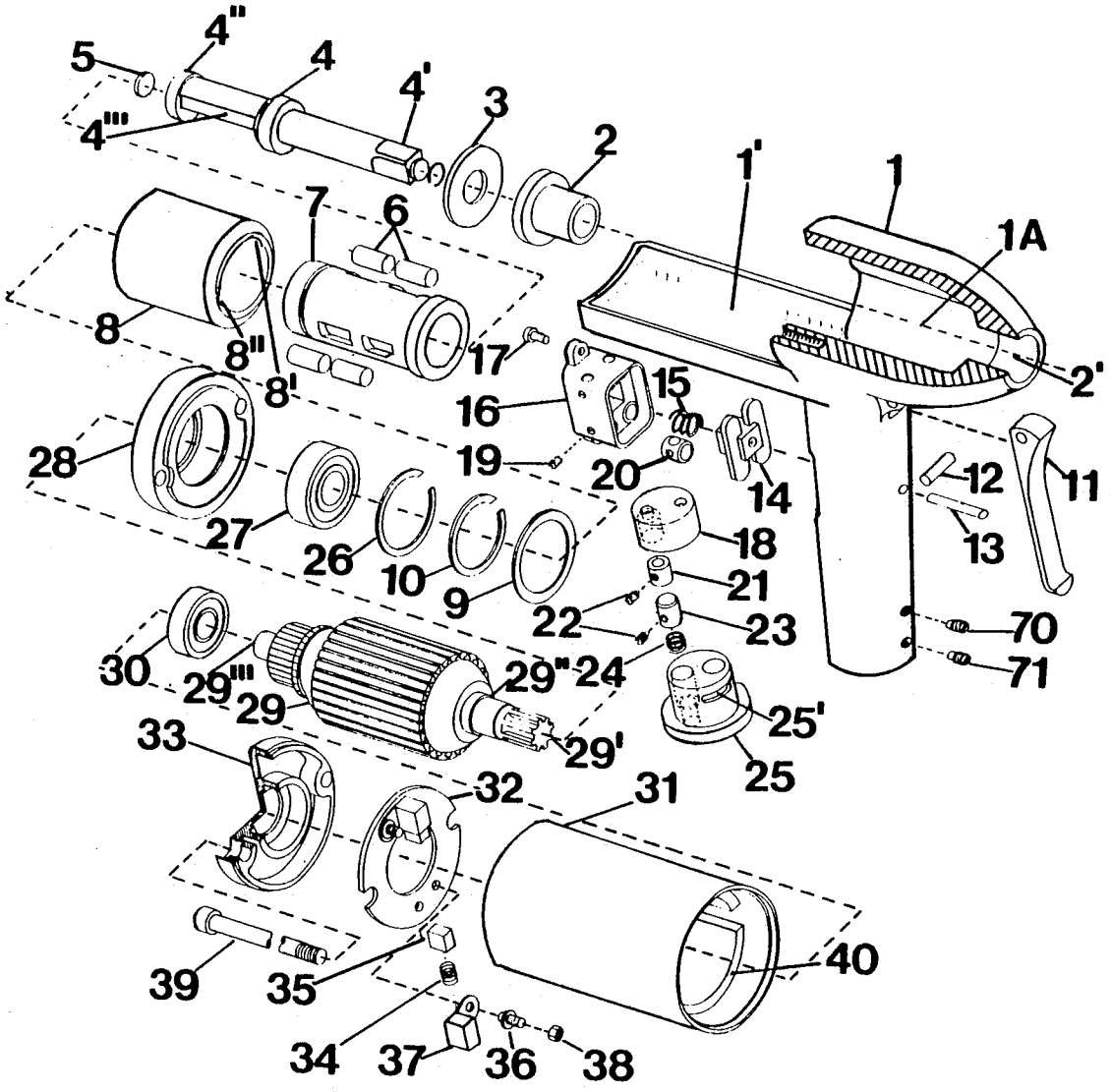
FIG. 3 is an exploded assembly view showing parts of the invention inter-related.

In FIGS. 1 and 3, the one piece cast aluminum housing has an open cradle 1' which creates a cavity for the motor wiring 61, 61' (FIG. 2) and supports the motor 31. Area 1A is the hammer compartment which allows for a sealed area for operation and lubrication. The end bell 28 creates this seal while the end cap 33 seals the motor assembly. The anvil 4 is visible at the front end of the housing 1, protruding through the end bushing 2.

The long trigger 11 operates the switch plunger 13 which turns the wrench on and off. Input power cables not shown, coupled with cables 50 and 51 supply current through reversing switch housing 25 for forward and reverse operation.

FIG. 2 is a sectional view through the tool showing the square drive end 4' of anvil 4 protruding from housing 1, and end bushing 2, anvil sleeve 7, anvil sleeve pins 6, hammer 8, with armature 29 spline connected to anvil sleeve 7 and aligned in forward bearing 27, carried in end bell 28.

Motor housing 31 carries field magnet 40 and surrounds armature 29. End cap 33 closes motor housing 31 and journals armature 29 in proper alignment by bearing 30. The brushes 37 and 37' are connected to insulated wires 61, 61' extending to On-Off switch housing 16 in electrical connection with inner switch contacts 20' and 20'' (FIG. 2E) respectively.

The operator may depress trigger 11 to cause switch plunger 13 to move double contact 14 (FIG. 2 and 2D) against contacts 20, 20', 20'' amd 20''' (FIG. 2E) by over powering spring 15. In this manner cables 50' and 51' are connected via the switch to motor wires 61, 61'.

It should be noted that turning the lower reversing switch housing 25, 180 degrees, switches these connections (reverses the polarity) to run the motor in the opposite direction so that removing and re-tightening wheel lug nuts can be accomplished in fast time. Alignment slot 25' receives screw 71 to complete the rotating structure.

Next, FIG. 3 shows all the parts of the tool with the exception of some of the contact parts found in the On-Off switch 16 and reversing switch housings 18 and 25. These duplicate parts have been left out to simplify this drawing.

It will be clear that the cast aluminum or alloy magnesium housing 1 includes a forward anvil and hammer compartment 1A, and a rear motor cradle 1'. End bushing 2 fits in opening 2' of compartment 1A to hold anvil 4 in proper place (see FIG. 2). Thrust washer 3 takes up the slack and cuts down the drag. The anvil 4 receives a conventional socket (not shown) on square shank end 4' and may utilize either a pin or ring type retainer. The rear anvil journal 4'' seats in the anvil sleeve 7 and together with the forward journal aligns the anvil in the sleeve. The cam shaped anvil rear end portion 4''' is the striking area. This area is maximized to greatly increase the hammering power without an excessively large motor armature 29. The anvil sleeve 7 slides into hammer 8 and is locked into position by snap-ring 10. Portion 4''' is eccentric to the anvil axis and carries opposed curved regions for making contact with pins 6, respectively in forward and reverse directions.

Figure 3A:
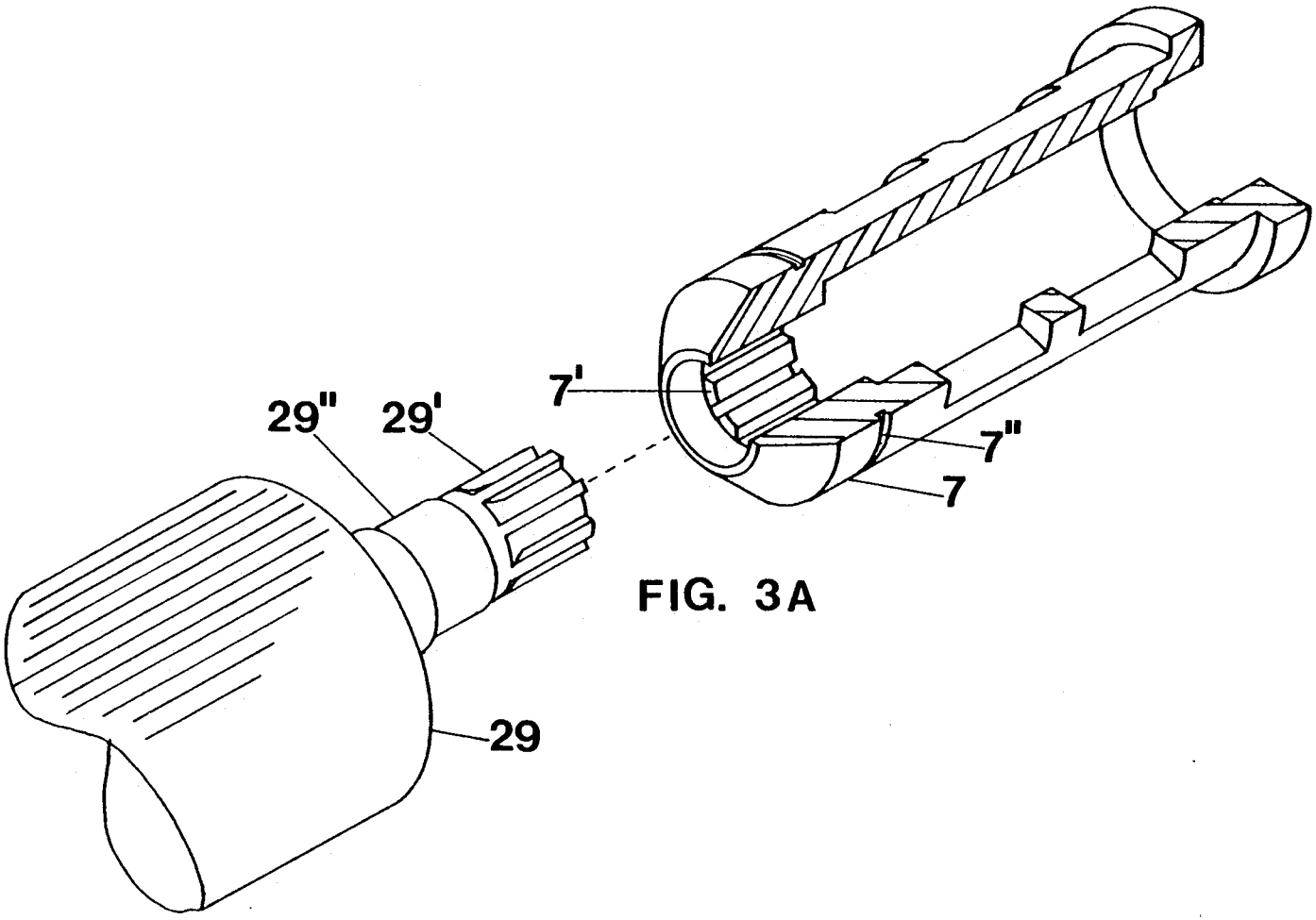
FIG. 3A is an exploded perspective view of the motor splines and the sleeve receiver.

FIG. 3A shows a femal spline receptical 7' (depth about ½ inch) for motor shaft splines 29'. The anvil sleeve 7 sits down inside the hammer 8 and is so retained by snap-ring 10. Thus, the anvil sleeve 7 extends through the hammer and by use of the splines 7' recessed (female) in it receives the armature's drive shank (male) splines 29'.

A conventional anvil is approximately 4 inches in length. The area contacting the pins 6 is approximately 1 and ¾ inches in length by ⅜ inch in width for a total of 0.66 sq. inch.

In the present invention, a typical anvil length is 6 inches. The area contacting the pins 6 is approximately 2 and ½ inches in length by ⅜ inch in width for a total of 0.94 sq. inches. The increased hitting area is necessitated by the use of 2 anvil sleeve pins 6 on each side of the anvil sleeve 7. As the anvil 4 rotates inside the anvil sleeve 7 it comes into contact with the pins 6 and pushes them outward into the grooves 8' and 8'' in the hammer 8. When the pins 6 bottom out in the grooves 8' and 8'', the hammer 8, pins 6 and anvil 4 become a one piece direct drive for a split second in time. Once the contact is made momentarily, the anvil slips, spins around and the process happens again at a rapid rate. Thus giving the tool its IMPACT name. By increasing the anvil size, the number of pins, the anvil sleeve size and the hammer size, the weight of all these parts is also increased. As is well known, the bigger the hammer the harder it can strike. When the D.C. motor spins the hammer assembly with DIRECT DRIVE and high torque, the increased hammer assembly size provides a much improved power output than would normally be achieved with a conventional assembly. It is also true that the assembly will stand up to repeated use with a lower failure rate. The heavier the parts the more durable they become allowing them to last much longer.

FIG. 3A also further explains how the armature 29 and anvil sleeve 7 connect inside the impact wrench. Notice how the splines of the armature and the ones cut into the anvil sleeve align themselves while the tapering on the armature creates a STOP. Snap-ring 10 (FIG. 3) retains the anvil sleeve down inside the hammer with the motor splines recessed about ½ inch inside the sleeve. The hammer assembly is pushed forward to within 1/16 of an inch of the bushing 2, being separated only by forward thrust washer 3. Thus, the clearance at the bushing 3 in the nose of the gun's housing is kept to a minimum by the exact fit obtained from the way the splines are cut on the armature 29 and inside the anvil sleeve 7.

DESIGN ADVANTAGES

The use of a STOP (tapering out the splines on the armature) keeps the anvil sleeve from moving any further up onto the armature and aids in maintaining a tight close fit. Any slack that exists in an impact wrench can create more chance for mechanical breakdown. Relative to air impact hammering assemblies, the present design utilizes a larger hammer assembly which in turn will have more durability, hitting power, and will not require running in a reservoir of oil. All air impact wrenches have some kind of oil reservoir. To have one, each impact must have a way to seal off that area from the motor and at the nose where the anvil is exposed. In most cases however; given the extreme operating P.S.I. of most users (150 to 190 P.S.I.) the seal between the motor and the oil reservoir is often blown and the oil is pushed out the seal around the anvil. Once the oil has left the reservoir, the hammering parts will quickly wear out because they need this lubrication.

In the present invention, each part is dipped into an oily coating (clinging type lubricant) before assembly which will remain in the housing because there will be no pressure inside it. Another advantage of the subject hammer assembly is the way the anvil sleeve and hammer are held together. By the use of the snap-ring 10 (FIG. 3) installed in the groove 7'' (FIG. 3A) seen at the receptical end of the anvil sleeve, the hammer is firmly held into place. Given the stress, temperature of operation, state of wear after years of use, this snap-ring should last where other designs do not. In fact; one design of air impact hammer assembly uses a rubber O ring in a similar manner. Once subjected to oil saturation in the oil reservoir, this ring begins to swell and once operating temperature reaches a certain level it will slip out of its groove and cause the assembly to lock up. The present invention has no oil reservoir so there never is any danger of oil leaking out while in storage or into the trunk space of an automobile.

The hammer assembly is preferably made from steel and is unique in utilizing four hammer pins 6, two axially spaced apart in each groove 8' and 8'' of hammer 8. The hammer is much larger than conventional hammers in air-powered impact wrenches because the increased size allows the impact to develop more torque without increasing the size of the motor armature 29. Minimum lubrication is necessary and the hammer assembly need not be immersed in oil or covered with thick coatings of grease, as required in the prior art. For a 200 foot pound model, the hammer assembly weight is approximately 3 pounds. The total weight of such impact including the four foot power cables 50, 51 (FIG. 1) is apprx. 11 pounds.

In FIG. 3, the pins 6 are designed to extend about one third of their bodies into the spaced apart slots 6'.

A socket (½ inch drive) is attached to the end of the anvil 4' and then placed upon a nut the size of the socket's hex opening. If the nut is to be removed, the impact will need to be in the reverse position. By squeezing the trigger 11, the motor will be activated and the hammer will begin to break the nut loose by its hammering action. When the hammer assembly spins, the anvil sleeve 7 rotates inside the hammer 8 repeatedly. The hammer pins 6, are moved out of their slots 6' in the anvil sleeve 7 by the centrifugal force created by this spinning action. However; the grooves in the hammer 8' and 8'' only allow the pins to move a short distance out of their slots 6' in the anvil sleeve before bottoming out in the grooves 8' and 8''. This momentary bottoming out causes the hammer pins 6 to protrude into the area where the anvil 4 is located. The striking area of the anvil 4''' (FIG. 3) now comes into contact with the two hammer pins 6. The grooved area of the hammer 8' and 8'' is designed to allow the hammer pins to slip a fraction of an inch after each striking motion. One set of pins 6 are struck during forward impacting while the other set is struck during reverse.

This slip and hit action creates the hammering or impacting that allows the impact to achieve its torque without stalling out or completely stopping the spinning motor. The D.C. motor driven impact has far greater hitting power than an A.C. powered version because, by being DIRECTLY DRIVEN instead of GEAR DRIVEN, a more positive torque from the motor to the hammer is created. In fact, the larger armature 29 found in the D.C. motor has a much larger rotating mass than any found in an A.C. impact and is much larger than one found in an air powered impact as well. By establishing a good ratio between the motor and hammer as done here, the impact will perform with less strain and have the feel of being more balanced so the user can handle it with more ease.

The rear end 4'' of the anvil is perfectly sized to fit into the rear of anvil sleeve 7 for proper alignment with the thrust bumper 5 being present for same. The hammer pins 6 are approximately 1 and ⅛ inch in length and ⅜ of an inch in diameter. The bevelled (striking area) 4''' of the anvil 4 is approximately 2 and ½ inches in length on either side. The length of the hammer 8 is approximately 3 inches with a diameter of about 2 and ½ inches. The anvil 4 is approximately 6 inches in length and ⅝ inch in diameter. A conventional air impact anvil is 4 and ½ inches in length and ⅝ inch in diameter. As previously stated, the larger and heavier the hammer assembly, the longer it will last.

In FIG. 3, end bell 28 receives ball bearing 27, bearing retainer snap-ring 26, while anvil sleeve retaining snap-ring 10 and spacer washer 9 are best seen assembled in FIG. 2. Bearing 27 receives and aligns armature 29 shaft 29'' at the forward end of the motor.

The rear shaft 29'' of armature 29 is aligned by ball bearing 30 in end cap 33. Two screws 39 secure the motor housing 31 assembly together with brush plate 32 oriented by the screws, which may be ¼×20 machine bolt thread type. The forward ends of the screws are received in the walls of compartment 1A.

Two brush holders 37 (FIG. 3) are oppositely affixed to brush plate 32 by stud screws 36 and nuts 38 to carry brush contacts 35. Field magnet 40 is suitably affixed to the interior of housing 31.

In the reversing switch 25 of FIG. 2, the top portion of the reversing switch is held in place in the housing by a set screw 70 (FIG. 3) located in the second from bottom hole in the housing shown in FIG. 2B. The lower set screw 71 aligns itself into a groove 25' (FIG. 3) in the lower portion of the reversing switch. The groove 25' assures proper alignment during rotation of the switch located in the lower end of the housing. The switch 25 rotates and snaps into place (makes contact) by the use of two springs 24 (FIG. 3) which force contacts 23 (lower) and 21 (upper) together. Contact points found on contacts 23 are bevelled so that when rotation occurs they will depress themselves when they come into contact with the bakalite housing. Once full rotation is complete they are allowed to spring upward to make connection with the upper contacts 21. As previously stated, because of duplication and for the sake of simplicity, some of the contacts just mentioned are not shown in FIG. 3. Rotating the lower part of the switch 25 actually reverses the polarity of the D.C. current going to the D.C. motor. For a D.C. motor to have such capability to turn forward and reverse, it must have a set of motor brushes 35, one brush every 180 degrees around the armature 29. Shown here is a D.C. two pole motor which is simplest in design. A four pole motor used for powering a winch would provide more torque and less amperage draw from the battery source.

Given the right rechargeable battery source (FIG. 4) the subject impact wrench could be made totally portable. A.C. powered impacts could not be portable unless you could carry a generator on your back. Even if you could do so, the generator most likely would not produce the amperage necessary to operate a powerful impact wrench.

Figure 4A:
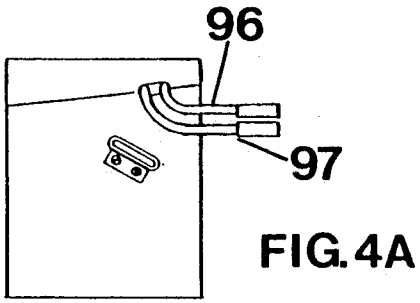
FIG. 4A shows an automobile battery with 25 foot long lead cables.
Figure 4B:
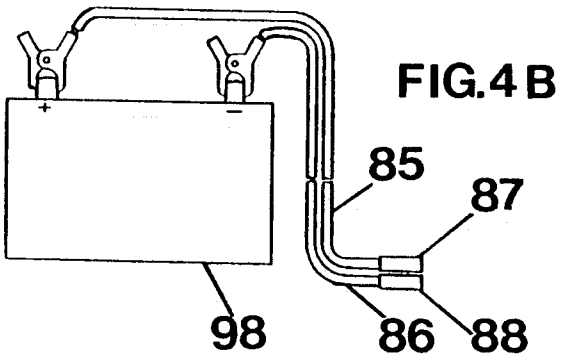
FIG. 4B shows 5 foot long jumper cables with male plugs for engaging the female plugs of FIG. 4A.

The present D.C. impact needs only 50 to 75 amps of current under a load. In most cases, a very tight lug nut (100 to 150 foot pounds) can be removed with a 2 to 3 second burst of power. Therefor; a great number of nuts could be removed and re-tightened without any significant drain on a fully charged car battery (FIG. 4A). For optimum power, it is best to use 4 gauge leads to carry current from the battery. Welding style cable works the best because it will carry more current with less resistance and will not stiffen up in cold weather. It is this 4 gauge cable that makes the best jumper hookup for starting cars and it is for this reason that I have included a short set of cable ends (FIG. 4B) that can be attached to the end of the powering cables 77 and 78 (FIG. 4A) giving the user a 30 foot set of jumpers.

The present D.C. wrench has several advantages over the pneumatic (air driven) impact wrenches. First of all, when you compress air you also compress whatever moisture is in the air as well. The biggest threat to an air impact wrench is moisture that is blown through it. The vanes that make the rotor turn by catching the moving air will absorb the moisture. This absorption causes the vanes to swell up which prevents them from sliding freely in and out of the slots of their motor. If they cannot slide out all the way they do not catch as much air as before and power loss results. The more air that is not caught creates more exhaust which can be harmful to the user. In addition to moisture, most compressed air contains rust, pipe scalings and various other matter that will clog the workings of the air impact. These common problems make the air impact very unreliable and costly to maintain. These problems are magnified in unreliable and costly to maintain. These problems are magnified in the larger models (¾ inch and 1 inch drive) because they require larger volumes of air than the smaller models and are much more costly to maintain.

The 25 foot lead cables, 75, 76 (FIG. 4A) are 4 gauge welding style cable. On the end of each cable is a female receptacle 77, 78 in which each accessory can be plugged. By attaching a set of short cables 80, 81 (FIG. 4B) that have clamps 82, 83 on them, the leads are converted to a set of 30 foot jumper cables. These cables are capable of carrying 500 amps of D.C. current.

Figure 4C:
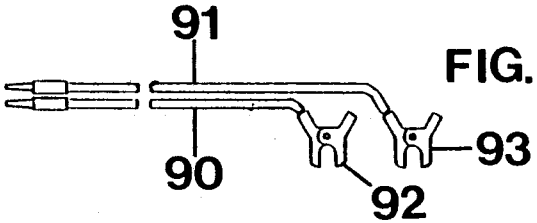
FIG. 4 is an elevational view of a rechargeable battery pack.

FIG. 4 shows a light weight rechargeable battery pack 85 with short cables 86, 87 and FIG. 4A shows a conventional automobile battery 88.

In general, in FIGS. 5–9, a ring-like hammer member 8 surrounds the orbit of the pins or impact elements 6, and means mount the hammer member in the housing 1 for rotary motion essentially in unison with the hammer pins or impact elements, but the hammer member is capable of limited relative rotary motion in respect to the impact elements. Cam means are periodically actuated by the output shaft to move the hammer member forward ahead of the anvil member to cause the impact elements to move radially inwardly into the path of the impact receiving jaw and transmit an impact blow from the hammer transversely through the impact element to the impact receiving jaw.

Figure 5:
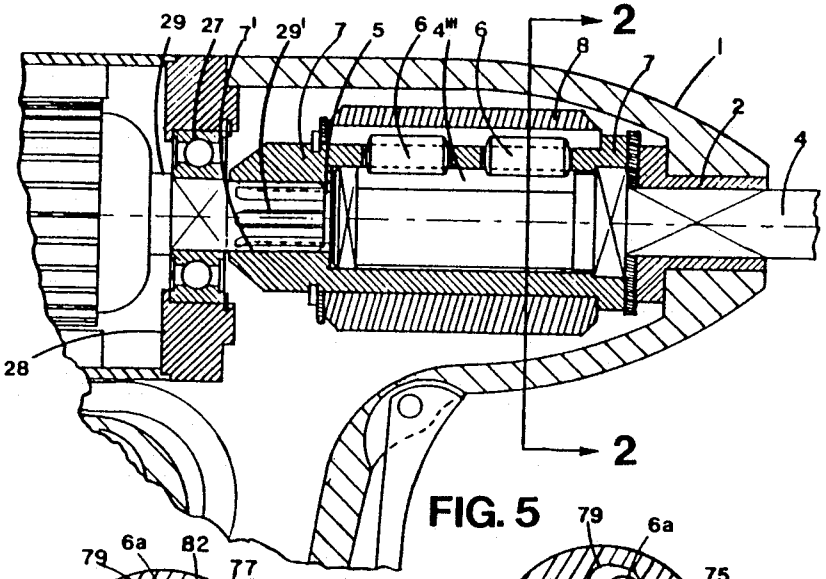
FIG. 5 is a side view of a tool with the hammer - and/or clutch assembly shown in longitudinal section.

With reference to FIG. 5 there is shown a housing 1 within which is contained a motor (not shown) having a drive shaft 29″. Drive shaft 29″ has a male splined end 29′ which is in rotary driving engagement with a female splined end 7′ of an anvil sleeve 7, thereby to cause the member 7 to rotate in unison with the drive shaft of the motor. A bearing mounts the drive shaft 29″ and is permanently mounted in the end bell 28 of the direct current motor 31.

An output shaft 4 is mounted by a sleeve bearing 2 in the forward end of housing 1, and it extends from outside the housing to a location inside the housing, adjacent to but spaced slightly from, the end of the motor drive shaft 29′ by a bumper 5. The output shaft 4 includes an impact receiving jaw 4‴ having a forward face 75 (FIGS. 6 and 7) and a reverse impact face 80, and the jaw is radially disposed on the periphery of output shaft 4, shown in FIGS. 6 thru 9. The anvil member 7 is essentially ring shaped and has a pair of slots 76 and 77 which extend radially through it, and which extend lengthwise in a direction parallel to the output shaft 4 of the tool.

Two elongated pins or impact elements 6 (impact rollers) are mounted in slots 76 with axis parallel to the axis of the output shaft 4, and the impact elements 6 are radially displaced from the shaft 4 so that it can rotate in an irregular orbit about the output shaft. Two impact roller elements *6a* are mounted in slots 77 of the anvil member with axis parallel to the axis of the output shaft, and it likewise rotates in an irregular orbit about the shaft as the anvil member 7 is driven by the motor drive shaft 29′.

A ring-like hammer member 8 is mounted in the housing and surrounds the anvil member 7, the hammer pins or impact elements 6, and the cam elements *6a*. Preferably, it is mounted on the cage member, and it is capable of rotary motion essentially in unison with the impact elements 6, cam elements *6a* and cage member 7, but it is capable of limited relative rotary motion in respect to these elements. The bore of the hammer member 8 is axilly grooved at two locations 78, 79 to accomodate the impact elements 6 and the cam elements *6a*.

The face 75 of the impact receiving jaw 4‴, together with the cam rollers elements *6a* and the slanted face 82 of groove 79 form the cam means for periodically actuating the clutch mechanism in a forward direction. An annular space 81 exists between the output shaft 4 and the bore of the anvil member 7 throughout most of the circumference of the member, and both the impace elements 6 and the cam elements *6a* at times in the operating cycle, extend inwardly into this space 81, and extend outwardly into axial grooves 78 and 79 in the bore of the hammer member 8. In operation in the forward direction the rotating motor drive shaft 29″ directly rotates the member 7 through the splined connection 7′, 29′, thereby directly rotating both the impact roller elements (pins) 6 and the cam roller elements *6a*. As shown in FIGS. 6 thru 9, rotation is in a clockwise direction.

Figure 6:
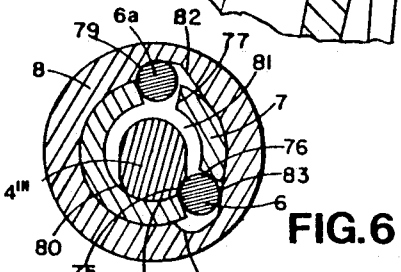
FIG. 6 is a transverse section taken along line 2—2 of FIG. 5, showing the clutch in its impact position.

In FIG. 6 the moment of impact is shown and the massive ring-like hammer member 8 is exerting force on the impact roller elements 6, area 83 of the wall groove 78, and the impact elements 6 are in contact with the face 75 of the impact receiving jaw 4‴ of the out-put shaft 4. Consequently, the impact blow from the hammer member 8 is transmitted transversely through the elongated impact elements 6 to the jaw 4‴ on the output shaft 4. Thus, the solid, roller-like, elongated impact elements 6 transfer the high impact forces from the hammer to the impact receiving jaw 4‴ of the output shaft 4, there being no sharp reentrant corners or angles involved which would lead to high stress concentration and premature failure at high torques.

Figure 7:
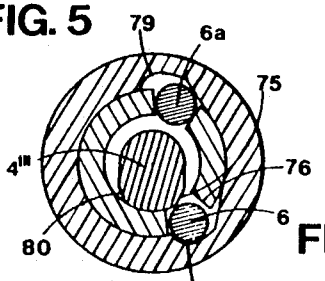
FIG. 7 is a similar view showing the clutch in its disengaged position.
Figure 9:
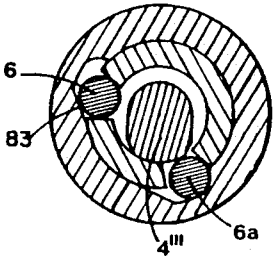
Figure 8:
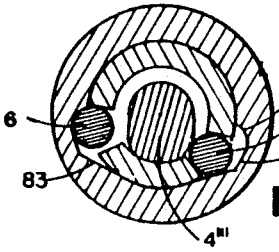
FIG. 8 is a similar view showing the clutch at the beginning of the cam engagement position; and, FIG. 9 is a similar view showing the clutch at the end of the cam engagement position as it is ready for impact upon further rotation.

After the impact blow, a disengaging action takes place, shown already accomplished in FIG. 7. During the disengaging action, anvil member 7 is driven forward relative to hammer 8, displacing the impact elements 6 outwardly into groove 78 in the bore of the hammer element 8, and simultaneously the slanted wall area 82 of groove 79 displaces the cam rollers *6a* inwardly into space 81 of hammer element 8. Rotation of member 7, the roller elements 6 and *6a* and the hammer member 8 then takes place in unison. The impact roller elements 6 pass over the outer surface 84 of the impact receiving jaw 4‴ from the area of the impact face 75 to a position beyond face 80 which is the end of the land area 84, as shown by the change between FIGS. 8 and 9. During this motion, acceleration of the hammer takes place. FIGS. 8 and 9 show the beginning and end of the cam action of cam rollers *6a* as the member 7 drives the rollers 6a off of the impact receiving face 75 and against face 82 of the hammer element 8, thus causing hammer 8 to rotate forward ahead of the member 7. As this is happening, face 83 of the hammer element 8 causes rollers 6 to be cammed radially inwardly into space 81, which is the position shown in FIG. 9. The anvil member 7, the hammer element 8 and roller elements 6, 6a are now in the proper position for another impact blow which by further rotation of these members has carried rollers 6 around to the impact receiving face 75, as shown in FIG. 6. Repeated cycling of the tool causes repeated blows from the hammer to the output shaft 4.

Reverse action of the tool is similar to the aforedescribed forward action, but with the motor shaft 29'' operating in the reverse direction. The impact rollers and the cam rollers have reversed roles, with the impact rollers of the forward direction becoming the cam rollers in the reverse direction and the cam rollers of the forward direction becoming the impact rollers in the reverse direction. Because of this "symmetry of action", the two sets of rollers are preferably identical in size and shape. During reverse operation face 80 of the impact receiving jaw 4''' takes the place of face 75, and becomes the reverse direction impact receiving face.

In summary, by increasing the number of pins or impact elements from one set to two sets, increasing the impacting area of the impact receiving jaw and increasing the size of the hammer element, the impacting motion will create a stronger (higher torque) impacting blow than that of a smaller version that would need a larger motor to achieve the same torque output.

The subject D.C. powered wrench could be invaluable to our military. Not only could they have a good dependable impact for use in the field, they would have one that requires no source of A.C. or compressed air for operation. Both of these types of impacts would require some sort of fuel powered generator or air compressor which would produce noise, have to be carried and need constant refueling.

The subject D.C. powered wrench could be serviced very easily in the field because the motor and hammering device can be separated by the removal of two screws 39 and then releasing of the cables from the top portion of the On-Off switch 16. The motor brushes are the same as you would normally find in a D.C. motor with one exception. Most motors have a plastic (bakalite) carrier that holds the brushes in the proper position and alignment around the armature. In this invention, each brush is mounted individually by the use of the brush holder 37 (FIG. 3). The operator can easily replace the brushes in the motor, but might not have such success with the conventional type because it is hard to get them back into the proper alignment. With the motor and housing separated from one another the hammer assembly can be easily inspected, lubricated and repaired if necessary.

The subject D.C. powered wrench could be used by electric company linemen who normally have to use only hand tools when working in the buckets used for servicing transformers. Being totally portable in nature, the linemen would not need to have a line of current running down to their truck. This would allow them to make faster and safer repairs even in the rain or snow. Another portable unit could be used to assemble metal girders, drive metal screws into sheet metal buildings and a multitude of other uses that could be much safer than using A.C. current. Farmers and ranchers could work out in their fields without the need of an air compressor or generator. Outdoor sign companies, bridge builders, metal structure erectors, mining companies, off road construction companies, and a host of other users should be very appreciative of this design.

What is claimed is:

1. A direct drive impact wrench, comprising in combination:

a wrench housing;

a direct current motor and motor housing means carried by the wrench housing;

said motor comprising a splined shaft on one end thereof;

an anvil carried by the wrench housing adjacent an end of the wrench housing;

direct drive means carried by the wrench housing and connected between said splined shaft and said anvil;

means for connecting the motor to a source of electrical power for intermittently driving the anvil;

said direct drive means comprise;

an anvil sleeve receiving said splined shaft and carrying said anvil;

a tubular hammer disposed on the anvil sleeve;

said hammer having a pair of spaced apart grooves in the inner periphery thereof;

said anvil sleeve having a plurality of spaced apart slots through its periphery;

a plurality of pins respectively disposed between the slots and the grooves whereby momentum from the hammer is intermittently transferred to the anvil upon rotation being imparted to said sleeve;

said pins are dimensioned to fit approximately one third of their bodies into the slots and to be engaged and disengaged by the hammer grooves upon said motion being imparted to said sleeve;

the grooves in the hammer are diametrically opposed and the slots in the sleeve are axially spaced apart in groups which are diametrically opposed;

the anvil includes curved striking regions disposed to strike all pins;

said housing comprises a hollow handle;

a reversing switch and an On-Off switch disposed in said handle;

electrical connections extending from the motor to said switches for connection to an external power source;

said reversing switch comprises an upper part affixed to the housing and a lower part rotatably carried by the housing for selecting forward and reverse polarity for motor drive; and, said lower part includes a semi-circular alignment slot and said housing comprises a means extending into the slot establishing alignment of the lower part during rotation.

2. The wrench of claim 1, wherein:

said On-Off switch is disposed in said handle;

said switch comprises a plunger extending through a hole in said handle; and two sets of moveable switch contacts responsive to said plunger which forces the two sets of switch contacts together when depressed.

3. The wrench of claim 2, further comprising:

a trigger which is hingedly mounted adjacent to the upper most part of the handle, thereby allowing the operator ease of operation without exerting much force by the fingers and minimizing the risk of having the trigger broken off from dropping the wrench.

4. The wrench of claim 3, wherein:

said means for connecting the motor to a source comprises two short lead cables and two tapered male brass plugs;

said two lead cables being attached to the rotating part of the reversing switch, said male plugs being adapted to be inserted into female counterparts located on the end of source cables.

5. A single piece housing for a direct current impact wrench wherein said impact wrench comprises a motor within a motor housing and an anvil hammer assembly connected thereto, said single piece housing comprising a metal body portion having a front end and a rear end;

a hollow handle portion integral with the body portion;

said body portion comprising an elongated open-curved cradle substantially "C-shaped" in cross-section for receiving a cylindrical motor housing;

said body portion further comprising a compartment at the front end for receiving an anvil hammer assembly, an opening at the rear end of the compartment having an inner diameter greater than that of an anvil hammer which it receives, and an opening in the front end for receiving an anvil;

end cap means to locate the motor in the motor housing and the motor housing in the cradle; and, screw means for removeably fixing the end cap means to the front end compartment, thereby facilitating disengagement of the motor from said single piece housing.

6. The housing of claim 5 wherein:

the cradle is grooved to approximately the same curvature as the motor housing to receive the housing snugly at the end cap means and form a protective seal.

7. The housing of claim 6 wherein:

said handle is substantially hollow and said wires for the motor extend along the lower external portion of the motor housing within said cradle and further extend down the handle.

8. The housing of claim 7, wherein:

said screw means comprise only two screws thereby facilitating motor removal and access to the anvil hammer assembly.

9. A direct drive impact wrench, comprising in combination:

a wrench housing comprising a body portion having an elongated open curved cradle substantially C-shaped in cross-section at a rear end thereof, a middle portion, and a front end compartment having a rear end opening and a forward end opening with a depending hollow handle at least open to the cradle;

a direct current motor and motor housing means carried by the wrench housing with the motor housing supported by the cradle;

said motor comprising a splined shaft on one end thereof;

an anvil carried by the wrench housing forward compartment with one end of the anvil protruding through the forward end opening, the rear end opening of said compartment having an inner diameter greater than the diameter of said anvil;

direct drive means carried by the wrench housing and connected between said splined shaft and said anvil;

wires extending from the motor and along the cradle beneath the motor housing to exit the wrench via the hollow handle for connecting the motor to a source of electrical power for intermittently driving the anvil;

said direct drive means comprising;

an anvil sleeve receiving said splined shaft and carrying said anvil;

a tubular hammer disposed on the anvil sleeve;

said hammer having a pair of spaced apart grooves in the inner periphery thereof;

said anvil sleeve having a plurality of spaced apart slots through its periphery;

a plurality of pins respectively disposed between the slots and the groove whereby momentum from the hammer is intermittently transferred to the anvil upon rotation being imparted to said sleeve;

an end cap for locating the motor housing in the cradle and, screw means removably fixing the end cap to the forward compartment to facilitate removal of the motor from the cradle and to permit the motor and anvil hammer structure to be removed from the housing.

10. The wrench of claim 9, further comprising:

an on-off switch and reversing switch housing in said handle;

said wires being connected to said switch;

an on-off trigger carried by said handle externally of the handle for actuating said switch; and said reversing switch housing extending outwardly of the handle and adapted for at least partial rotation to reverse the connections to said wires.

* * * * *